US005886479A

United States Patent [19]

Kennedy et al.

[11] Patent Number: 5,886,479

[45] Date of Patent: Mar. 23, 1999

[54] PRECESSION OF THE PLASMA TORUS IN ELECTRODELESS LAMPS BY NON-MECHANICAL MEANS

[75] Inventors: Paul G. Kennedy, Grasonville; Edward H. Hooper, Baltimore, both of Md.

[73] Assignee: Northrop Grumman Corporation, Los Angeles, Calif.

[21] Appl. No.: 969,271

[22] Filed: Nov. 13, 1997

[51] Int. Cl.[6] ..... H05B 41/16

[52] U.S. Cl. ..... 315/248; 315/39; 315/344

[58] Field of Search ..... 315/248, 39, 344; 313/234, 594, 607

[56] References Cited

U.S. PATENT DOCUMENTS

| | | | |
|---|---|---|---|
| 843,533 | 2/1907 | Hewitt . | |
| 4,245,179 | 1/1981 | Buhrer | 315/248 |
| 5,047,693 | 9/1991 | Roberts et al. | 315/248 |
| 5,146,140 | 9/1992 | Piejak et al. | 315/248 |
| 5,227,698 | 7/1993 | Simpson et al. | 315/248 |
| 5,498,928 | 3/1996 | Lapatovich et al. | 315/39 |
| 5,519,285 | 5/1996 | Ukegawa et al. | 313/594 |
| 5,747,945 | 5/1998 | Ukegawa et al. | 315/248 |
| 5,767,626 | 6/1998 | Kamarehi et al. | 315/39 |

*Primary Examiner*—Don Wong
*Assistant Examiner*—Haissa Philogene
*Attorney, Agent, or Firm*—Walter G. Sutcliff

[57] ABSTRACT

A method and apparatus for exciting an electrodeless light bulb containing material including an inert gas and one or more chemical elements which generate a light emitting torus of plasma when excited by an RF signal and which includes two separate excitation coils oriented about the bulb so that the planes of each of the coils are mutually oriented 90° with respect to each other, and wherein each of the coils are driven by respective RF excitation voltages having mutually different frequencies, for example, a difference of 4%, so as to excite the material enclosed within the bulb and cause a stirring action of the fill and effect a pulsating emission of light and rotation of the torus similar to that produced by physical rotation of the bulb itself.

15 Claims, 2 Drawing Sheets

6 CYCLES PER 1/4 PERIOD OF FULL FIELD PATTERN ROTATION = 24 CYCLES/PERIOD, OR 1/24 X 100% = 4% RATE

6 CYCLES PER 1/4 PERIOD OF FULL FIELD
PATTERN ROTATION = 24 CYCLES/PERIOD, OR
1/24 X 100% = 4% RATE

PRECESSION OF THE PLASMA TORUS IN ELECTRODELESS LAMPS BY NON-MECHANICAL MEANS

BACKGROUND OF THE INVENTION

1. Field of the Invention

This invention relates generally to a method and apparatus for exciting a light source, and more particularly to a method and apparatus for exciting a high intensity electrodeless light bulb.

2. Description of Related Art

An electrodeless lamp technology is evolving which is based on generating light that confines light emitting plasma generated and sustained by RF excitation. RF energy is coupled into an electrodeless lamp through a coupling coil or other means external to a bulb in order to form and sustain a plasma in the materials filling the bulb. The bulb normally contains an inert gas, such as argon, and an element from Group VI-A of the periodic table of elements, such as sulfur.

When such a bulb is excited, for example, by a single coil, energy is coupled into the bulb by transformer action as illustrated in FIG. 1. The primary winding of the transformer comprises an exciting coil 10 surrounding the bulb 12. The secondary winding comprises a single turn secondary contained within the exciting coil 10 and consists of a closed circular path or torus 14 of plasma formed in the bulb 12 when the contents are excited by an RF source 16.

The equivalent circuit of such a configuration is shown in FIG. 2. There reference numeral 18 denotes the transformer formed by the exciting coil 10 and torus 14. The electrical resistance of the torus is designated by reference numeral 20. An excitation signal $V_{coil}$ is generated by the RF source 16 and is coupled across the exciting coil 10. A load voltage $V_{torus}$ is depicted by the dashed closed circular line in FIG. 1 and comprises a voltage which appears across the secondary winding 14, i.e. the torus. When the exciting voltage $V_{coil}$ is applied to the coil 10, an H-field, which is normal to the plane of the exciting coil 10, is created within the area enclosed by the coil. Since the H-field is time varying due to the fact that the RF signal from the source 16 is an AC signal, it is accompanied by a toroidal E-field distribution in which the planes of the E-fields within the exciting coil parallel to the plane of the coil. The induced voltage around any enclosed E-field path is equal to the voltage per turn in the exciting coil times the ratio of the area enclosed by the toroidal path to the area enclosed by the exciting coil, that is, the voltage ratio is proportional to magnetic flux linkage.

Accordingly, as ionization occurs due to electromagnetic field heating of the material within the bulb, current flows in a closed toroidal path within the bulb, producing light by the heating of the material within the bulb. In any conducting toroidal path, the magnitude of current flow will equal the voltage induced around the closed path divided by the effective impedance of the path. The effective diameter of the resulting current path is such as to enclose the maximum cross section area of magnetic field, but is limited by cooling caused by the bulb's surface, which limits ionization near the inner surface of the bulb.

As the torus heats further, the Group VI-A element(s) are brought into the plasma, producing very bright light emission from a diffused region of the bulb. The spectrum of this light, which is dependent upon the fill, can be made to be very nearly that of sunlight.

Current flow in the torus counters much of the induced magnetic field within the torus. This causes the toroidal diameter to shrink. Stability is reached within the bulb when the voltage drop $V_{torus}$ across the torus due to coupling area falls to a sufficiently low level to minimize further build-up of toroidal current and further collapse of the torus due to cancelled magnetic field. This is the operating equilibrium condition of the lamp. If the equilibrium is not reached because of low resistance around the torus and current continues to rise, then the plasma will pinch off and the light will be extinguished.

Physically rotating the bulb creates a centrifugal force on the fill molecules which counteracts the constricting magnetic forces by pushing the molecules outward, tending to keep the torus as large as possible. The result is that the conducting toroid plasma emits more light and is less prone to extinguish due to ionic pinch off. Since this centrifugal force involves mechanical rotation of the bulb at speeds up to 10,000 Hz, it is inherently less than desirable for a commercial lamp system.

SUMMARY

Accordingly, it is an object of the present invention to provide an improvement in high intensity light sources.

It is another object of the invention to provide an improved method and apparatus for exciting a high intensity electrodeless light bulb.

It is further object of the invention to provide a method and apparatus which produces a dispersive effect on the plasma of physical rotation without mechanically moving or rotating the bulb.

It is yet another object of the invention to provide an electrodeless lamp system having an improved commercial appeal.

The foregoing and other objects of the invention are achieved by a method and apparatus for exciting an electrodeless light bulb containing material including an inert gas and one or more chemical elements which generate a light emitting torus of plasma when excited by an RF signal and which includes two separate excitation coils oriented about the bulb so that the planes of each of the coils are mutually oriented 90° with respect to each other, and wherein each of the coils are driven by respective RF excitation voltages having mutually different frequencies so as to excite the material enclosed within the bulb and cause a stirring action of the fill and effect a pulsating emission of light and rotation or precession of the torus similar to that produced by physical rotation of the bulb itself. In the preferred embodiment, the RF excitation voltages have frequencies which mutually differ by about 4%, whereupon the rotation rate of the torus plane and the pulsating torus will be at 4% of the average of the two driving frequencies.

Further scope of applicability of the present invention will become apparent from the description provided hereinafter. It should be understood, however, that the detailed description and specific examples set forth therein, while disclosing the preferred embodiment of the invention, are provided by way of illustration only, since various changes and modifications coming within the spirit and scope of the invention will become apparent to those skilled in the art from this detailed description.

BRIEF DESCRIPTION OF THE DRAWINGS

The present invention will become more fully understood from the detailed description provided hereinafter and the accompanying drawings which are provided by way of illustration only, and thus are not meant to be limitative of the invention, and wherein.

DETAILED DESCRIPTION OF THE INVENTION

Figure 1:
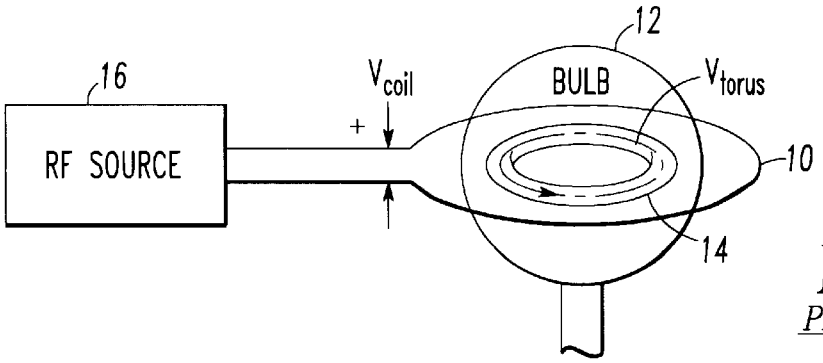
FIG. 1 PRIOR ART
FIG. 1 is a diagram depicting conventional magnetic coupling of energy into an electrodeless lamp by the use of a single coupling coil driven by an single RF source.
Figure 2:
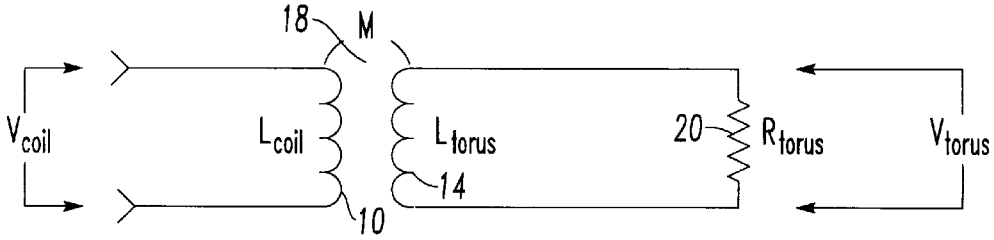
FIG. 2 PRIOR ART
FIG. 2 is an electrical equivalent circuit diagram of the arrangement shown in FIG. 1.

While the prior art relating to inductive excitation is shown in FIG. 1 and typically involves mechanically rotating the electrodeless bulb 12 in order to provide a dispersive effect on the fill molecules by pushing the molecules outward so as to keep the torus 14 relatively large so as to emit more light and to counteract the extinguishing effects of ionic pinch off, the present invention is directed to providing excitation of the lamp where the dispersive effect on the plasma is achieved without mechanically moving or rotating the bulb 12.

Figure 3:
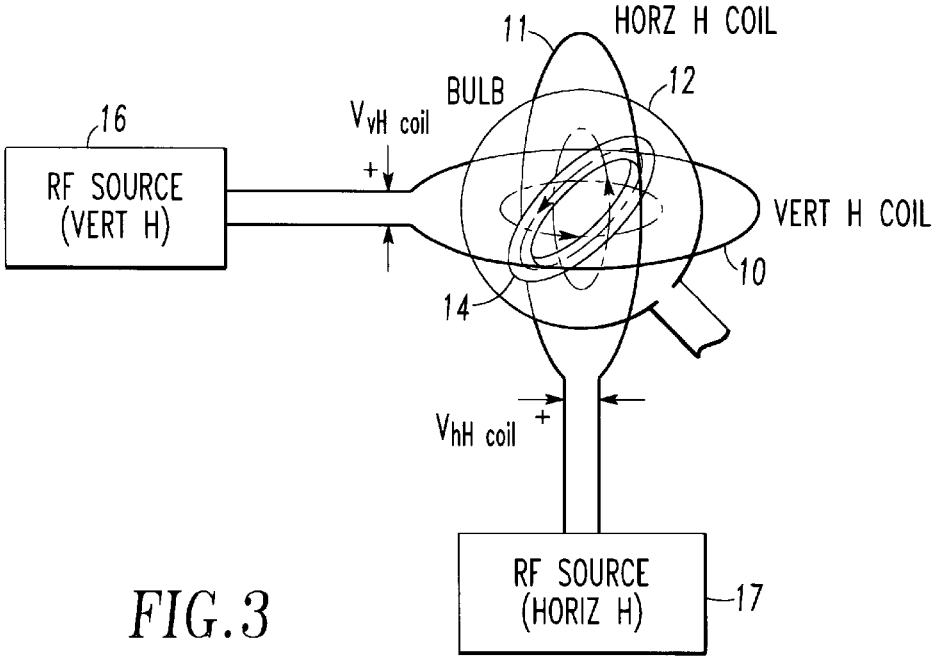
FIG. 3 is a diagram illustrative of the preferred embodiment of the invention.

As shown in FIG. 3, two planar excitation coils 10 and 11 are disposed around the electrodeless light bulb 12 so that their respective planes are in quadrature relationship, i.e. 90°, with respect to one another. The two excitation coils 10 and 11 are also respectively connected to and independently excited by a pair of RF sources 16 and 17. Moreover, the sources 16 and 17 generate RF signals having mutually different frequencies and more particularly frequencies differing by only a slight amount, for example, by 4%.

When the two coils 10 and 11 are energized, the resulting H-field vector for each coil passes through the bulb 12 and undergoes polarization changes in a plane which is normal to or mutually at right angles with the planes of the two exciting coils 10 and 11 while corresponding E-field vectors lie in the respective planes of the coils. With reference to FIG. 3, coil 10 generates, for example, a vertical H-field vector in response to a $V_{vHcoil}$ voltage applied from RF source 16 while coil 11 generates a horizontal H-field vector in response to a $V_{hHcoil}$ coil voltage applied from RF source 17.

The presence of the second excitation coil 11 augments the RF excitation provided by coil 10, while at the same time providing a force to cause a precession of the torus of plasma 14 generated inside the bulb 12 when the materials filling the bulb are excited by the two separate RF signals applied thereto from the sources 16 and 17.

If the two excitation coils 10 and 11 were driven at the same frequency, the resulting H-field would rotate or reverse direction synchronously with the coil drive frequency. The result would be an elliptically polarized H-field within the bulb 12 centered in a plane bisecting the planes of the two coils 10 and 11. Depending upon the magnitude of the RF drive voltages and mutual phase angles thereof, polarization would be between linear and circular polarization accompanied by an appropriate orthogonal E-field.

Figure 4:
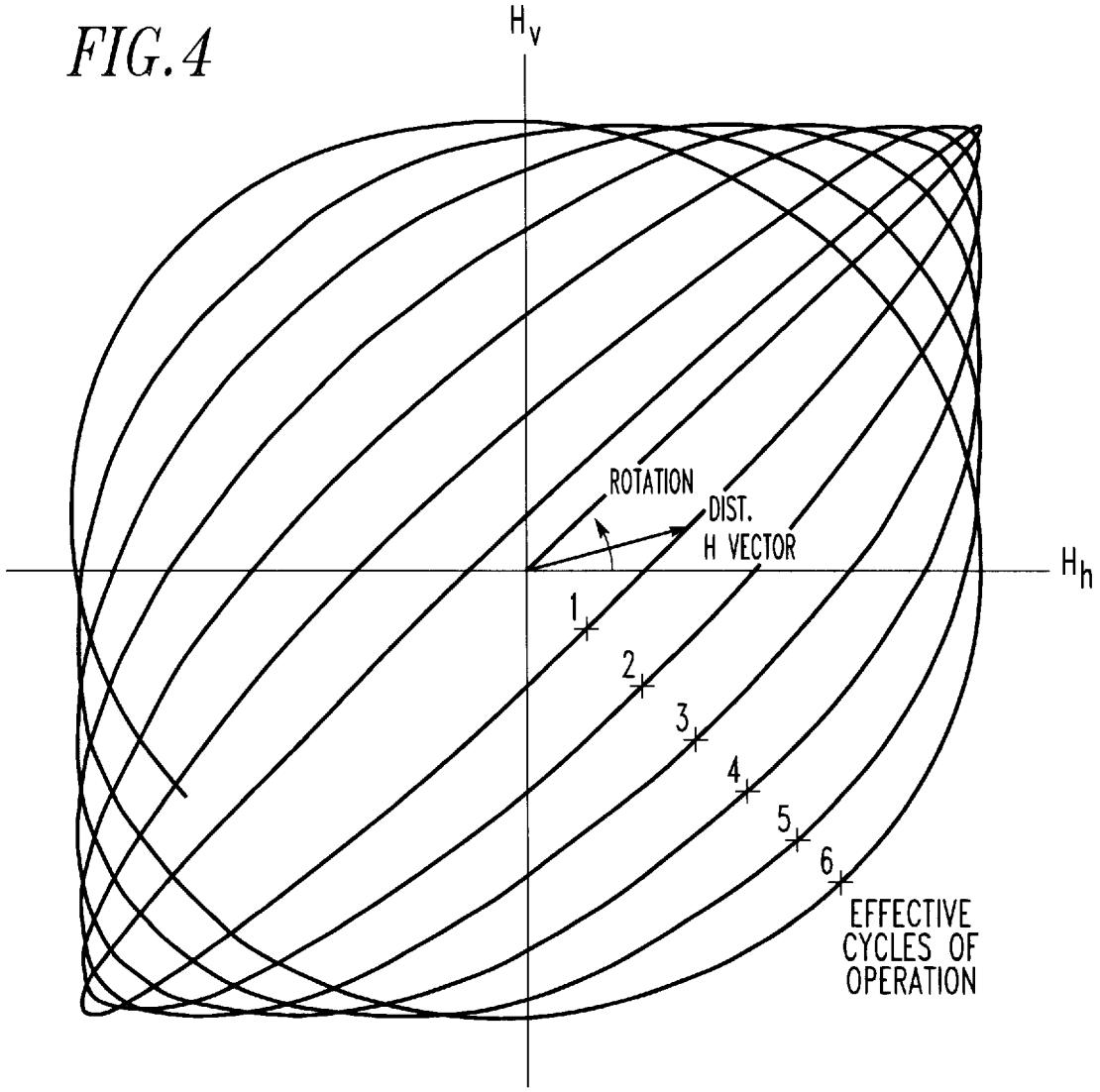
FIG. 4 is a graph illustrating precession of a plasma torus generated in the embodiment of the invention shown in FIG. 3.

However, when the two exciting coils 10 and 11 are driven at different frequencies, the H-field moves between linear polarization in one quadrant and linear polarization in an adjacent quadrant 90° removed in a plane normal to the planes of the two coils. Between the two linearly polarized modes, the H-field moves to a region of elliptical polarization as shown in FIG. 4 which is illustrative of the movement of the instantaneous H-field vector through a plurality of RF drive cycles as a plot of the vector locus with time for a drive frequency different of 4%. The result of this action is a moving torus of plasma of varying intensity which is of a maximum intensity at every 90° of time rotation. Thus a pulsing and rotating E-field torus normal to the H-field is generated as the H-field rotates.

This form of excitation leads to a reduction in the bulb's surface cooling effect on the moving torus and therefore increases the size of the torus which in turn results in greater light production. For a bulb excitation by frequencies differing by 4%, the rotation rate of the torus plane and the pulsating torus will be at 4% of the average of the two driving frequencies.

A benefit of the present invention is that the power supplied by each amplifier in the two RF sources 16 and 17 is one-half or less than that supplied by a single amplifier through a single coil. This impacts on the circuit approach to the required driver-amplifiers in the RF sources due to the fact that the reduction in power level permits substantial reduction in device costs where transistors, for example, are utilized in the amplifiers.

Thus what has been shown and described is a means of exciting an electrodeless light bulb to obtain maximum light without physical rotation of the bulb. This is due to the fact that the motor action of a rotating E-field applied to the plasma torus is a source of the required motion. While inductive coupling has been shown and described, the same principles are applicable to other known types of coupling techniques.

Having thus shown and described what is at present considered to be the preferred embodiment of the invention, it should be noted that the same has been made by way of illustration and not limitation. Accordingly, all modifications, alterations and changes coming within the spirit and scope of the invention as set forth in the appended claims are herein meant to be included.

We claim:

1. An excitation circuit for an electrodeless lamp including a light bulb containing material including an inert gas and one or more chemical elements which generate a light emitting torus of plasma when excited by an RF signal, comprising:

means for generating two RF excitation signals having respective predetermined mutually different frequencies;

means located adjacent said light bulb for applying said two RF excitation signals to said light bulb so as to excite said material and cause a stirring action within said material, thereby generating a predetermined movement of the torus which increases the size of the torus and the amount of light emitted therefrom.

2. An excitation circuit according to claim 1 wherein said means for applying said two RF excitation signals comprises first and second signal coupling elements oriented about said light bulb so as to apply said two RF excitation signals to said material at two different angles.

3. An excitation circuit according to claim 2 wherein said first and second signal coupling elements comprise first and second mutually perpendicular excitation coils.

4. An excitation circuit according to claim 2 wherein said first and second signal coupling elements comprise a pair of concentric planar induction coils, said coils being oriented so that a plane of one coil through said light bulb is about 90° with respect to the plane of the other coil.

5. An excitation circuit according to claim 2 wherein said means for applying said RF excitation signals comprises two coils mutually oriented at right angles for generating a pair of mutually orthogonal H-fields and forming thereby a composite rotating H-field which moves between linear polarization in adjacent quadrants with a region therebetween of elliptical polarization causing a rotatably moving pulsing torus of plasma to be generated having a maximum intensity at every 90° of rotation.

6. An excitation circuit according to claim 1 wherein said different frequencies comprise frequencies which are relatively close to one another.

7. An excitation circuit according to claim 1 wherein said predetermined different frequencies mutually differ by about 4%.

8. An excitation circuit according to claim 7 and wherein said means for applying said two RF excitation signals comprise first and second signal coupling elements oriented about said light bulb for orthogonally applying said RF signals thereto.

9. An excitation circuit according to claim 7 wherein said means for applying said RF excitation signals comprise a pair of mutually perpendicular induction coils for generating respective H-fields which form a composite rotating H-field and an orthogonal pulsing E-field, thereby generating a rotating torus having a pulsed emission of light.

10. A method of exciting an electrodeless light bulb containing material including an inert gas and one or more chemical elements which generate a light emitting torus of plasma when excited by an RF signal, comprising the steps of:

generating two RF excitation signals having respective predetermined mutually different frequencies; and applying said two RF excitation signals to said light bulb so as to excite said material and cause a stirring action within said material, thereby generating a predetermined movement of the torus which increases the size of the torus and the amount of light emitted therefrom.

11. A method according to claim 10 wherein said step of applying said two RF excitation signals comprises applying said two RF excitation signals to said material at two mutually different angles.

12. A method according to claim 10 wherein said step of applying said two RF excitation signals comprise applying one of said two RF excitation signals to said material orthogonally with respect to the other of said two RF excitation signals.

13. A method according to claim 12 wherein said different frequencies comprise frequencies which are relatively close to one another.

14. A method according to claim 12 wherein said different frequencies mutually differ by about 4%.

15. A method according to claim 12 and wherein said step of applying includes generating mutually perpendicular H-fields and orthogonal pulsing E-fields, thereby generating a rotating torus having a pulsed emission of light.

* * * * *